United States Patent [19]

McIngvale

[11] Patent Number: 4,638,737

[45] Date of Patent: Jan. 27, 1987

[54] MULTI-WARHEAD, ANTI-ARMOR MISSILE

[75] Inventor: Pat H. McIngvale, Huntsville, Ala.

[73] Assignee: The United States of America as represented by the Secretary of the Army, Washington, D.C.

[21] Appl. No.: 749,847

[22] Filed: Jun. 28, 1985

[51] Int. Cl.[4] ..... F42B 13/04; F42B 13/50; F42B 15/26

[52] U.S. Cl. ..... 102/489; 102/476; 102/518; 102/703

[58] Field of Search ..... 102/476, 489, 393, 491, 102/494, 517, 518, 703; 89/36.17

[56] References Cited

U.S. PATENT DOCUMENTS

| | | | |
|---|---|---|---|
| 3,903,804 | 9/1975 | Luttrell et al. | 102/489 |
| 4,497,253 | 2/1985 | Sabranski | 89/36.17 |
| 4,516,502 | 5/1985 | Klein et al. | 102/703 |
| 4,524,697 | 6/1985 | Böcker et al. | 89/36.17 |
| 4,567,829 | 2/1986 | Ziemba et al. | 102/489 |
| 4,597,333 | 7/1986 | Böcker et al. | 102/518 |

*Primary Examiner*—Deborah L. Kyle
*Assistant Examiner*—Ted L. Parr
*Attorney, Agent, or Firm*—James T. Deaton

[57] ABSTRACT

A multi-warhead, anti-armor missile which includes a missile that has a booster section, a sustainer section, guidance and control means, and primary and secondary warhead sections at nose portions of the missile, with said primary warhead being designed for defeating basic armor of an enemy target and said secondary warheads being designed for dispersal into a cluster prior to the missile arriving at the target and arranged for defeating advanced armor explosive positioned around the basic armor.

5 Claims, 11 Drawing Figures

MULTI-WARHEAD, ANTI-ARMOR MISSILE

DEDICATORY CLAUSE

The invention described herein may be manufactured, used, and licensed by or for the Government for governmental purposes without the payment to me of any royalties thereon.

BACKGROUND OF THE INVENTION

It has been discovered that advanced armor techniques of the enemy employ a small armor explosive charge that can deform the explosive cone of a shaped charge or deflect the armor piercing subcaliber round normally used in destroying armor such as on a tank. Therefore, there is a need for a multi-warhead that has the capability of defeating armor that is protected with an outer explosive charge arrangement that is designed to defeat a round that has a single blow effect.

Therefore, it is an object of this invention to provide a multi-warhead that has a multiplicity of subcaliber warheads that are designed to strike the target and destroy the small protective explosive charges around the armor and then deliver the main warhead to the armor proper for piercing the armor in an effective manner.

Another object of this invention is to provide a multi-warhead arrangement in which a missile has both a boost and sustainer phase which lends itself to deploying the subcaliber warheads from the missile proper prior to the main charge being delivered at the target.

Still another object of this invention is to provide a multi-warhead which has the capability of being boosted to speeds in the hypervelocity range.

A still further object of this invention is to provide a multi-warhead that is driven by a missile that has a booster motor and a sustainer motor.

Other objects and advantages of this invention will be obvious to those skilled in this art.

SUMMARY OF THE INVENTION

In accordance with this invention, a multi-warhead missile is provided that has a multiplicity of flechette warheads at the nose portion of the missile and a shaped charge or other main warhead designed to destroy advanced armor with the missile being designed with a sustainer and booster arrangement for propelling the missile with the warheads thereon to a target and for deploying the flechettes so that they arrive at the target before the main warhead. This arrangement causes the flechettes to have the capability of defeating advance armor on a target and then allow the main charge to defeat the main armor of the target.

DESCRIPTION OF THE PREFERRED EMBODIMENT

Figure 1:
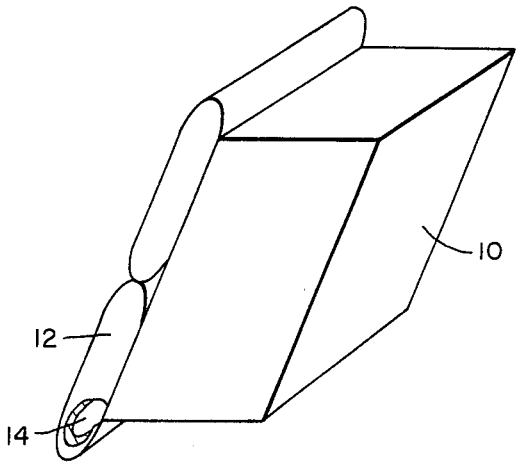
FIG. 1 is a schematic sketch of modern armor variation of the type desired to be defeated.

In accordance with this invention, a multi-warhead, anti-armor missile is provided and is designed for defeating armor of the type schematically illustrated in FIG. 1 in which the basic armor 10 such as of a tank is further protected such as by a plurality of metallic cases 12 that are glued or bonded to the outer surfaces of basic armor 10. Metallic cases 12 each contain a small explosive charge 14 which forms with cases 12 a shield about the section of basic armor 10 whose vulnerability is improved by these explosive charge metallic cases. The explosive charges 14 and metallic cases 12 produce shock waves which deform the explosive cone of a conventional shaped charge or they serve to deflect an armor piercing discarding sabot round.

A multi-warhead, anti-armor missile in accordance with this invention for defeating shielded armor of the type described above includes missiles **10*a* and 10*b* in FIGS. 2 and 3 each of which have two warhead sections. Missile 10*a* has a shaped charge main warhead 16 and missile 10*b* has a heavy metal type main warhead 18 which is made of a material such as tungsten carbide or depleted uranium that is designed to deliver a concentrated blow to the main armor of an armored vehicle. Missiles 10*a* and 10*b* each have secondary warheads 20 as illustrated with a multiplicity of a depleted uranium or tungsten carbide flechettes 22 that are mounted in holders for deployment and enclosed by nose cone sections 26**.

Figure 3:
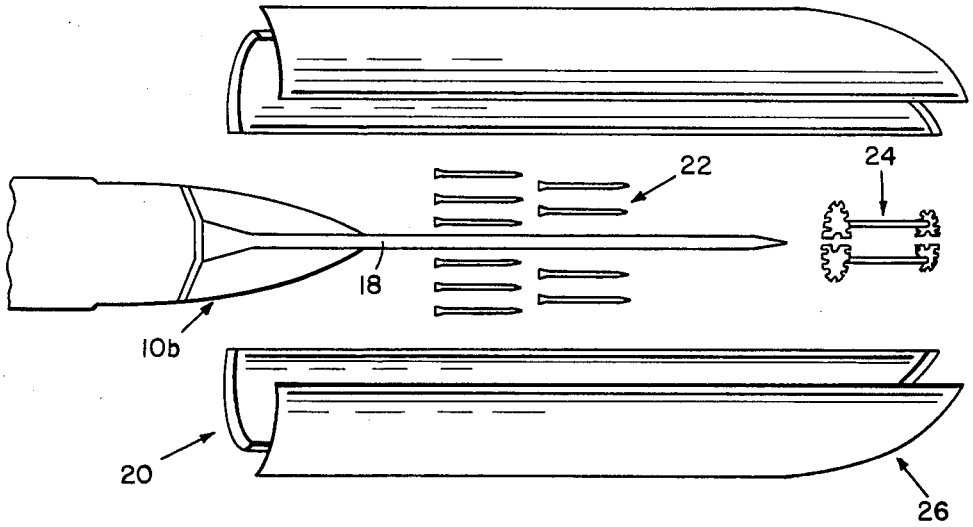
FIG. 3 is a schematic illustration of another embodiment of a multi-warhead in accordance with this invention.
Figure 2:
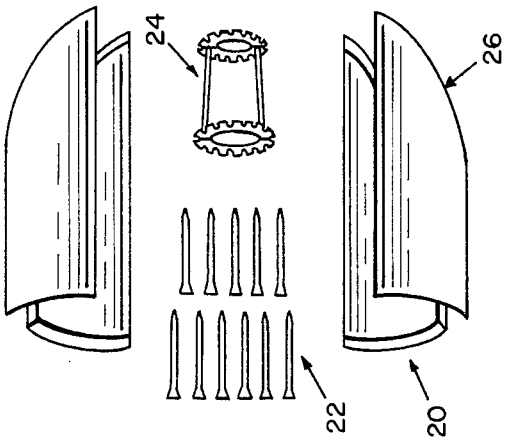
FIG. 2 is a schematic illustration of a multi-warhead, anti-armor missile in accordance with this invention.
Figure 2:
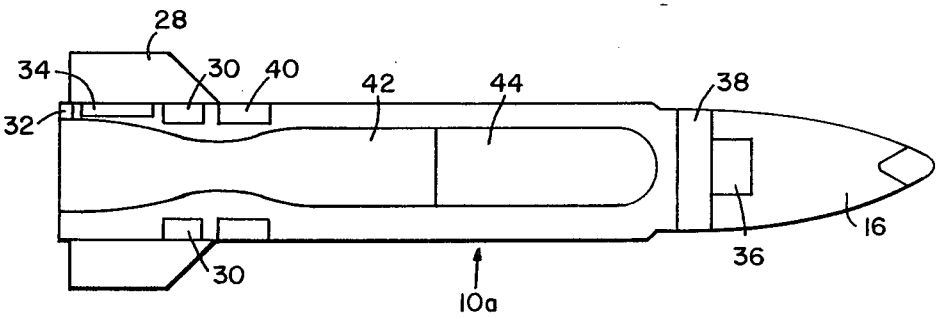

Missile **10*a* or 10*b* for which primary and secondary warheads are to be used must have several performance parameters in order to deliver the primary and secondary warheads to the target. Each missile must have a propulsion system that is capable of boosting the missile to a very high velocity of approximately 5,000 feet per second and a sustainer section for causing the primary warhead as illustrated in FIG. 3 to be delivered at a velocity of approximately 5,000 feet per second or the shaped charge primary warhead as illustrated in FIG. 2** at approximately 2,000 feet per second. The missile must also have the capability of first launching the missile and then going through a short coast phase after which the missile is propelled to the target at the required velocity. The technology to produce propulsion systems of this type is well known and various approaches can be used in delivering the required velocities for the selected primary warheads. Also, the actual sizing of the booster motor, sustainer motor and other missile structure will depend upon the overall sizing of the missile required for the particular range and the particular target desired to be destroyed. The structure of the missile itself is well known and well within the skill of those versed in this art.

Another important requirement for the missile in accordance with this invention is the ability to accurately guide the missile to a target. Although there are many ways to accomplish this, in this particular system, the missile cannot be guided using a nose mounted seeker due to the arrangment of the secondary warhead. Therefore, one of the best ways of accomplishing guidance of the missile is to use the known "beamrider" technique which utilizes a coded laser beam to communicate angular guidance errors or corresponding correction angles between the target location that is being tracked by a target tracking device and the missile position at any point during its flight. Another approach could be the wire guidance technique utilized by prior art missiles. Here, as with the beamrider, the missile gunner tracks a target by pointing a telescope or electro-optical sensor so that the target is within some tracking "gate". With the wire guided approach, the sensor also detects the location of the missile and the guidance computer calculates the correction angles for the missile. Other approaches of guidance of the missile are appropriate and are well within the knowledge of those skilled in this art.

Another requirement for success of this system is accomplishment of accurate timing of events. The technology of building accurate electronic timers that are reliable and rugged is well known. With digital circuit techniques electronic timers or clocks are available for accuracy far beyond the needs of this invention.

Referring now to FIG. 2, control of a missile such as 10*a* or 10*b* in accordance with this invention can be accomplished utilizing a missile with air vanes 28 that are adjusted by pneumatic, hydraulic or electrical actuators 30. Guidance can be obtained using a beamrider approach or some other means that does not require a seeker in the nose of the missile. Utilizing a beamrider approach, missile 10*a* has a receiver 32 mounted in the tail of the missile with processing electronics 34 mounted adjacent thereto. The control system is completed with inertial sensors 36, timing and signal processing electronics 38 and actuator driver electronics 40, all these elements are known, state-of-art technology and function in the normal manner for guiding the missile. Missile 10*a* also contains a booster motor section 42 for boosting the missile from the launcher and a sustainer motor section 44 that delivers the ultimate thrust for propelling the main warhead at its required velocity prior to striking the target.

Figure 4:
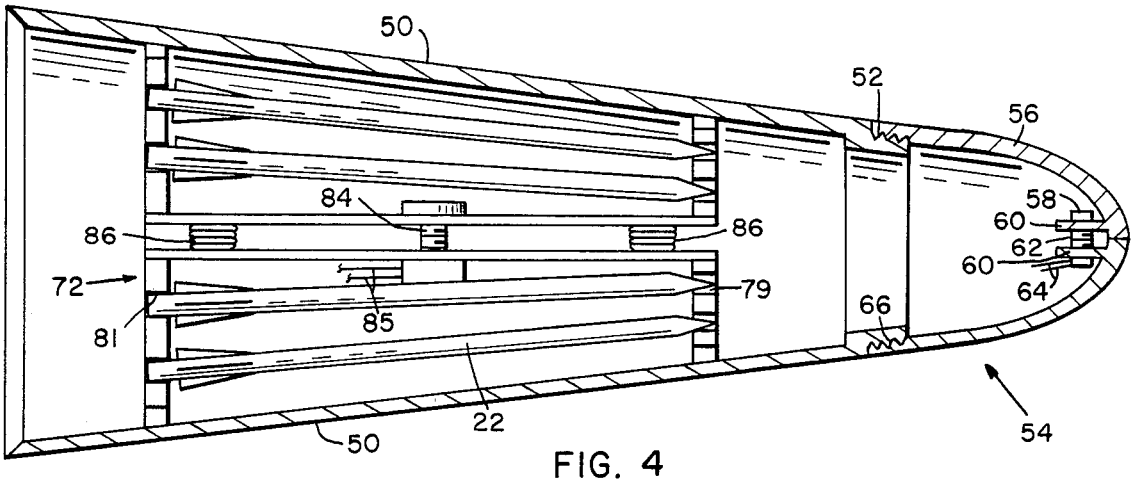
FIG. 4 is a view of the front nose cone of the missile with the subcaliber warhead flechettes and their mounting.
Figure 5:
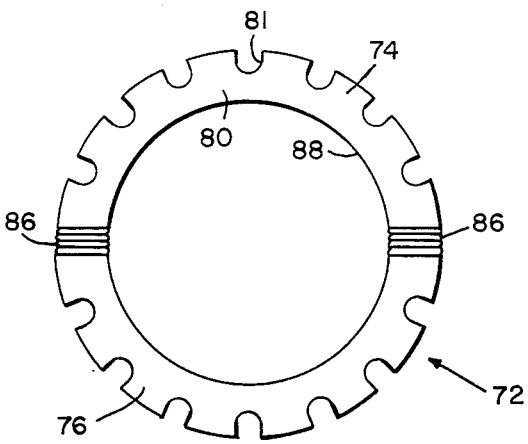
FIG. 5 is an end view of the missile holder fixture.
Figure 6:
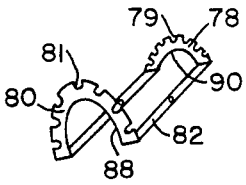
FIG. 6 is a perspective view of one half of the missile fixture holder.
Figure 8:
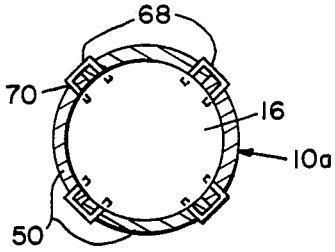
FIG. 8 is an illustration partially in section of the breakaway pins connecting the front nose cone section to the missile structure.
Figure 7:
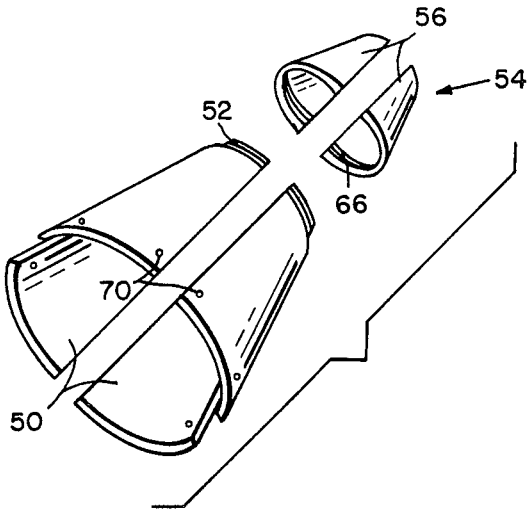
FIG. 7 is a pictoral view illustrating the disassembled parts of the nose cone which houses the subcaliber warhead flechettes.

Referring now to FIGS. 4 through 8 for the structure and mounting of the secondary warheads, this structure includes a multiplicity of cone sections 50 four of which are illustrated but a different number of sections could be used. Sections 50 are fitted together in a conventional manner to form a frustrum of a cone and are threaded at 52. A tip end nose section 54 is made of two halves 56 that are secured together by a pair (one of which is shown) of explosive bolts 58 (see FIG. 4) that are mounted in flanges 60 for holding halves 56 together and a spring means 62 is mounted between flanges 60 to bias halves 56 apart when explosive bolts 58 have been initiated through current applied through leads 64. Tip cone 54 is threaded at 66 and threads 66 mate with threads 52 to secure tip 54 to sections 50. Sections 50 are held together with a fixture (not shown) prior to being secured to the main body of the missile. Sections 50 can be secured in any conventional manner to the main body of the missile for holding the structure to the missile and being held in such a manner that these sections can be freely released from the missile when the secondary warhead is being separated from the missile carrying the parimary warhead. FIG. 8 illustrates breakaway pins 68 which are pressed into holes 70 in sections 50 and additional holes in the main missile body for holding the secondary nose cone structure to the main missile structure. Pins 68 are designed to be broken away when sections 50 are released by halves 56. The secondary warhead includes a multiplicity of subcaliber kinetic energy warheads 22 as illustrated in FIGS. 2, 3 and 4 and these subcaliber warheads are preferrably kinetic energy warheads that are referred to as flechettes and are made of heavy material such as depleted uranium or tungsten carbide. An alignment fixture 72 is provide for mounting the secondary warheads. Alignment fixture 72 includes halves 74 and 76 and each half has semicircular end members 78 and 80 that are joined together with side members 82. Semicircular end members 78 and 80 have notches 79 and 81 in surfaces thereof for mounting flechettes 22 therein. Halves 74 and 76 are secured together by explosive bolts 84 (see FIG. 4) that hold the halves together against springs 86. Explosive bolts 84 have electrical leads 85 connected thereto for causing the explosive bolts to be severed and allow springs 86 to move halves 74 and 76 apart when desired to deploy subcaliber flechettes 22. Other quick release mechanism than explosive bolts 84 could be used for causing submissiles 22 to be deployed, however, these devices work well. Halves 74 and 76 also have an inner opening 88 at one end and another opening 90 at the other end. These openings 88 and 90 allow holder 72 to be inserted over all or a portion of the primary warhead and nose section. If other securing means for holding fixture 72 in place relative to the main warhead is needed, this structure can be provided in accordance with the particular structure of the primary warhead. The structure as illustrated in FIG. 4 is assembled as described supra and attached to the main missile by pins 68 (see FIG. 8) engaging in holes 70 and in holes in the main missile structure to secure the secondary missiles in place relative to the primary warhead. It is understood that leads 85 of explosive bolts 84 and leads 64 of explosive bolts 58 are connected to the electronics of the missile for severing the bolts to cause deployment of subcaliber missiles 22 at the appropriate time.

Figure 9:
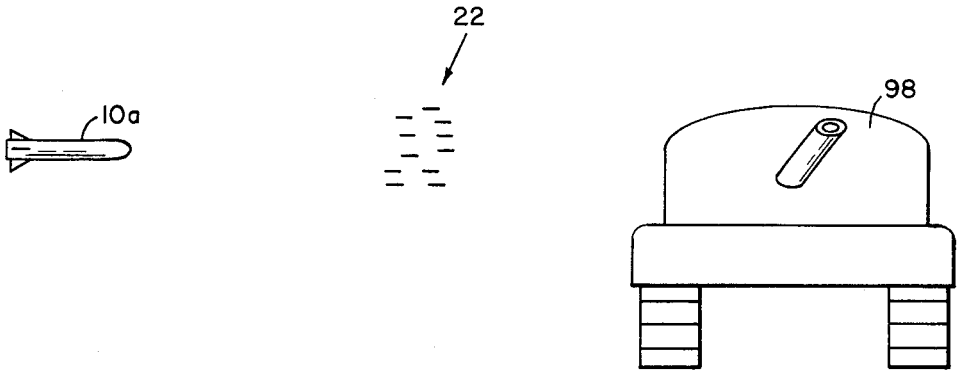
FIG. 9 is a view of the approaching subcaliber flechette warhead cluster and the main warhead as they approach a target.
Figure 10:
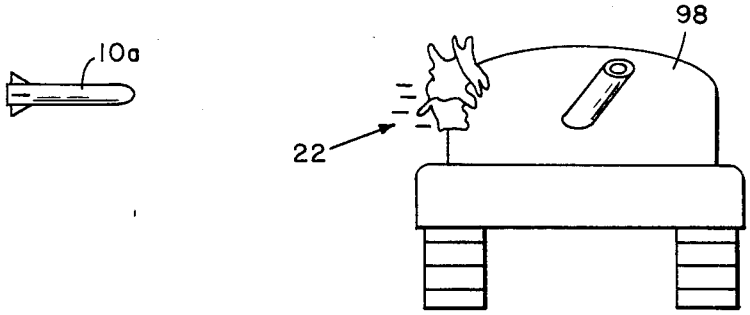
FIG. 10 illustrates how the subcaliber flechettes strike the target prior to the main warhead arriving.
Figure 11:
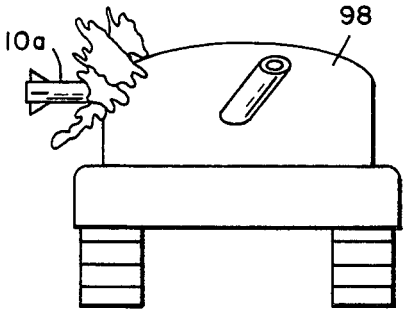
FIG. 11 illustrates the striking of the target with the main warhead.

In operation, prior to launch secondary warhead 20 containing the subcaliber warheads 22 is assembled and attached around and forward of main warhead 16 or 18 of missile 10*a* or 10*b*. Missile 10*a* or 10*b* is then launched in a conventional manner and boosted by booster motor 42 in a conventional manner to a velocity of approximately 5,000 feet/second. As the missile is launched, it is guided in a conventional manner toward the target by the guidance means previously described. At burnout of booster motor arrangement 42, the missile is trained on the target. An accelerometer or inertial sensor 36 on the missile senses the booster burnout and causes an electrical current to flow to leads 64 of explosive bolts 58 which causes springs 62 to release the two halves 56 of nose section 54. The two halves 56 fly away and at the same time the electrical current is supplied to the explosive bolts 58 or a short predetermined time thereafter and this current is supplied to the leads of explosive bolts 84. With the explosive bolts 84 released and nose sections 56 released, sections 50 pivot away from the missile due to high velocity windstream caught at the front of sections 50, pins 68 break, and fixture 72 moves outwardly to disperse subcaliber warheads 22. After separation from the missile, subcaliber warheads 22 continue flying toward the target such as a tank 98 illustrated in FIGS. 9, 10 and 11 and sections 50 and fixture 72 fly or tumble away. This of course assumes that the missile is trained on the target at the time of the separation of the secondary warheads. Because of the very low drag of the subcaliber warheads 22, they continue toward the target at close to the 5,000 feed/second velocity the missile had at booster burnout. The main missile 10*a* or 10*b* however, will slow down because of its greater drag. At a predetermined time after the above sequence depending upon the size of the missile and the specific main warhead used, a sequence is initiated by acceleration device 36 to cause sustainer motor arrangement 44 to be initiated. Sustainer motor arrangement 44 is then caused to propel the missile to target 98 such as is done with existing missiles with conventional warheads. However, since subcaliber kinetic energy warheads 22 preceed the main missile to target 98, the effect on the advanced armor of the target is as follows. Subcaliber warheads 22 arrive at target 98 in a loose cluster as illustrated in FIG. 9 some time ahead of main missile 10*a*. Subcaliber warheads 22 strike the outer armor such as that illustrated in FIG. 10 and begin to penetrate the outer armor and cause it to be defeated by these subcaliber warheads. When this occurs, the small explosive charges 14 in the outer armor case will explode, which will interrupt penetration of the subcaliber warheads, but because the main warhead of missile 10*a* has not yet arrived, it will not be affected. The main warhead will impact the target after the shock wave of the armor protective explosive has dissipated so that it can now penetrate the unprotected armor such as 10 in the usual manner. The timing functions and the size of sustainer motor arrangement 44 will be different for each of the main warheads 16 and 18 as described above due to the velocity each must be traveling at during the time of impact. The kinetic energy warhead 18 will have to be sustained at the very high velocity until impact, whereas the shaped charge warhead requires much lower speeds. The timing interval between booster cutoff and sustainer initiate is also different. The exact structure of the delivering missile as well as the exact structure of the main warheads are well known to those skilled in this art.

I claim:

1. A missile for defeating active armor of a target comprising a missile having a primary warhead and secondary warheads mounted at the front of the missile in nose cone sections with said primary warhead being designed to defeat basic armor of a target and said secondary warheads being designed for defeating explosive charge armor about the basic armor, said secondary warheads being mounted and clustered about a portion of said primary warhead and being encased in a portion of said nose cone sections and with a front most nose cone structure secured to said portion of said nose cone sections, and means mounting said secondary warheads, said portion of said nose cone sections and said front most nose cone structure whereby said secondary warheads can be released in flight to the target as a cluster prior to the main warhead arriving at the target to allow the secondary warheads to destroy explosive charge armor of the target prior to the main warhead delivering its blow to the basic armor of the target.

2. A missile for defeating active armor of a target as set forth in claim 1, wherein said missile has a booster arrangement and a sustainer arrangement for propelling the warheads to the target, and said secondary warheads comprising a multiplicity of heavy metal flechettes that are mounted in a holder about a portion of said primary warhead and in said portion of said nose cone sections, and said front most nose cone structure and said portion of said nose cone sections being about said secondary warheads and being releasable to allow said secondary warheads to be dispersed and fly ahead of the primary warhead on course to a selected target.

3. A missile for defeating active armor of a target as set forth in claim 2, wherein said holder is made of two sections that are secured together by explosive bolts to form an arrangement for releasing the secondary warheads, and the front most nose cone structure about said secondary warheads having a front most section that is made of two halves that are secured together by explosive bolt means that are releasable upon command to cause the front most nose cone structure and said portion of said nose cone sections about said secondary warheads to be removed and allow said secondary warheads to be dispersed.

4. A missile for defeating active armor of a target as set forth in claim 3, wherein said primary warhead is a shaped charged warhead.

5. A missile for defeating active armor of a target as set forth in claim 3, wherein said primary warhead is made of a heavy metal selected from tungsten carbide and uranium ore and wherein the sustainer arrangement is capable of propelling said primary warhead to said target at approximately 5,000 feet per second.

* * * * *